US009660335B2

(12) United States Patent
Chen et al.

(10) Patent No.: US 9,660,335 B2
(45) Date of Patent: May 23, 2017

(54) ANTENNA SYSTEM AND A COMMUNICATION DEVICE

(71) Applicant: Climax Technology Co., LTD., Taipei (TW)

(72) Inventors: Cheng-Wei Chen, Taipei (TW); Meng-Chih Lin, Taipei (TW); Dau-Chyrh Chang, Taipei (TW)

(73) Assignee: Climax Technology Co., Ltd., Taipei (TW)

( * ) Notice: Subject to any disclaimer, the term of this patent is extended or adjusted under 35 U.S.C. 154(b) by 44 days.

(21) Appl. No.: 14/825,955

(22) Filed: Aug. 13, 2015

(65) Prior Publication Data

US 2017/0012353 A1 Jan. 12, 2017

(30) Foreign Application Priority Data

Jul. 8, 2015 (TW) ..... 104122174 A

(51) Int. Cl.
*H01Q 1/48* (2006.01)
*H01Q 9/42* (2006.01)
*H01Q 19/22* (2006.01)

(52) U.S. Cl.
CPC ..... *H01Q 1/48* (2013.01); *H01Q 9/42* (2013.01); *H01Q 19/22* (2013.01)

(58) Field of Classification Search
CPC ..... H01Q 1/48; H01Q 1/38; H01Q 1/24
USPC ..... 343/848, 860, 700 MS, 876
See application file for complete search history.

(56) References Cited

U.S. PATENT DOCUMENTS 9,516,151 B2 * 12/2016 Moran ..... H04M 1/72527
2006/0109192 A1 * 5/2006 Weigand ..... H01Q 1/22 343/795
2008/0246684 A1 * 10/2008 Fujishima ..... H01Q 3/24 343/876
2010/0033397 A1 * 2/2010 Narasimhan ..... H01Q 1/38 343/860
2012/0249393 A1 10/2012 Hotta et al.
2013/0214982 A1 8/2013 Dean et al.
2015/0372372 A1 * 12/2015 Lee ..... H01Q 1/243 343/702
2016/0285173 A1 * 9/2016 Svendsen ..... H01Q 21/28

OTHER PUBLICATIONS

Dau-Chyrh Chang et al., "Efficiency Enhancement of Defect Monopole Antenna with Asymmetry Environment," The 2015 Asia-Pacific International EMC Symposium and Exhibition, May 28, 2015, pp. 5-7.
Extended European Search Report dated Nov. 25, 2016 in related European Application No. 15181258.3.

* cited by examiner

*Primary Examiner* — Huedung Mancuso
(74) *Attorney, Agent, or Firm* — Donald E. Stout; Stout, Uxa & Buyan, LLP

(57) ABSTRACT

An antenna system includes a monopole antenna with a first end connected to a feed point on a printed circuit board (PCB) and a second end being electrically floating; and a matching conductive stub with a first end connected to a ground point on the PCB and a second end being electrically floating.

24 Claims, 8 Drawing Sheets

ANTENNA SYSTEM AND A COMMUNICATION DEVICE

CROSS-REFERENCE TO RELATED APPLICATIONS

The entire contents of Taiwan Patent Application No. 104122174, filed on Jul. 8, 2015, from which this application claims priority, are incorporated herein expressly by reference.

BACKGROUND OF THE INVENTION

1. Field of the Invention

The present invention generally relates to an antenna system, and more particularly to an antenna system with a matching conductive stub connected to a ground point.

2. Description of Related Art

Wireless sensor network is composed of sensor devices (e.g., Z-wave devices). The Wireless sensor network is commonly used to carry out home automation due to its simple structure, low power consumption and low cost.

A monopole antenna is ordinarily used in the sensor device to receive or transmit signals. Usually design of the monopole antenna requires large ground plane to achieve high antenna efficiency. However, there is a growing trend of the sensor devices towards miniaturization, resulting in small ground plane with low (e.g., less than 20%) antenna efficiency.

FIG. 1A shows a schematic diagram of a conventional monopole antenna. A shorted stub 13 is used to enhance antenna efficiency. FIG. 1B shows an equivalent circuit of the shorted stub 13 of FIG. 1A. The shorted stub 13 is conventionally used to match impedance in order to improve on antenna efficiency. However, the shorted stub 13 cannot improve the situation for compact sensor devices. Moreover, it increases area of a printed circuit board (PCB) for the worse.

A need has thus arisen to propose a novel scheme to overcome drawbacks of the conventional antenna system.

SUMMARY OF THE INVENTION

In view of the foregoing, it is an object of the embodiment of the present invention to provide an antenna system with enhanced antenna efficiency. A matching conductive stub is used to effectively match impedance and raise radiation impedance, thereby substantially enhancing antenna efficiency and compensating for small ground plane of compact sensor devices.

According to one embodiment, an antenna system includes a monopole antenna and a matching conductive stub. The first end of the monopole antenna is connected to a feed point on a printed circuit board (PCB), and a second end is electrically floating. A first end of the matching conductive stub is connected to a ground point on the PCB, and a second end is electrically floating.

DETAILED DESCRIPTION OF THE INVENTION

Figure 1A:
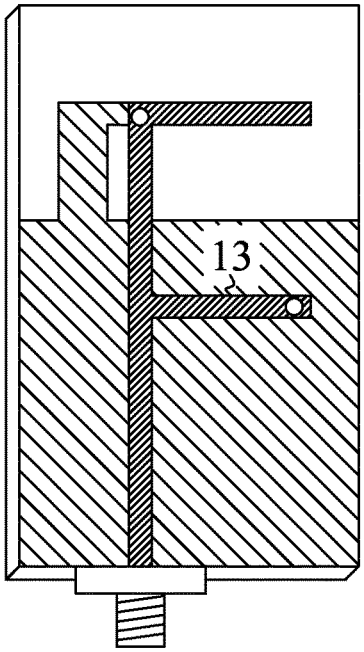
FIG. 1A (Prior Art)
FIG. 1A shows a schematic diagram of a conventional monopole antenna.
Figure 1B:
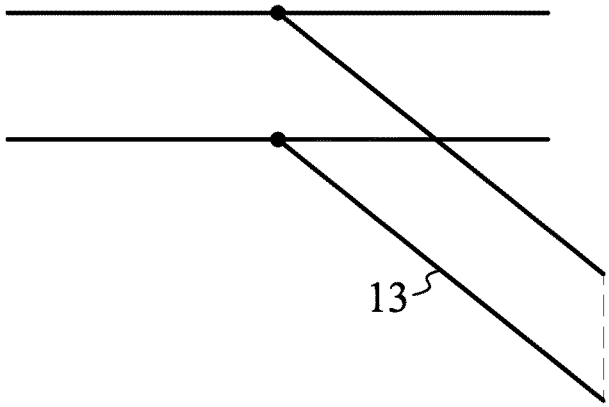
FIG. 1B (Prior Art)
FIG. 1B shows an equivalent circuit of the shorted stub of FIG. 1A.
Figure 2A:
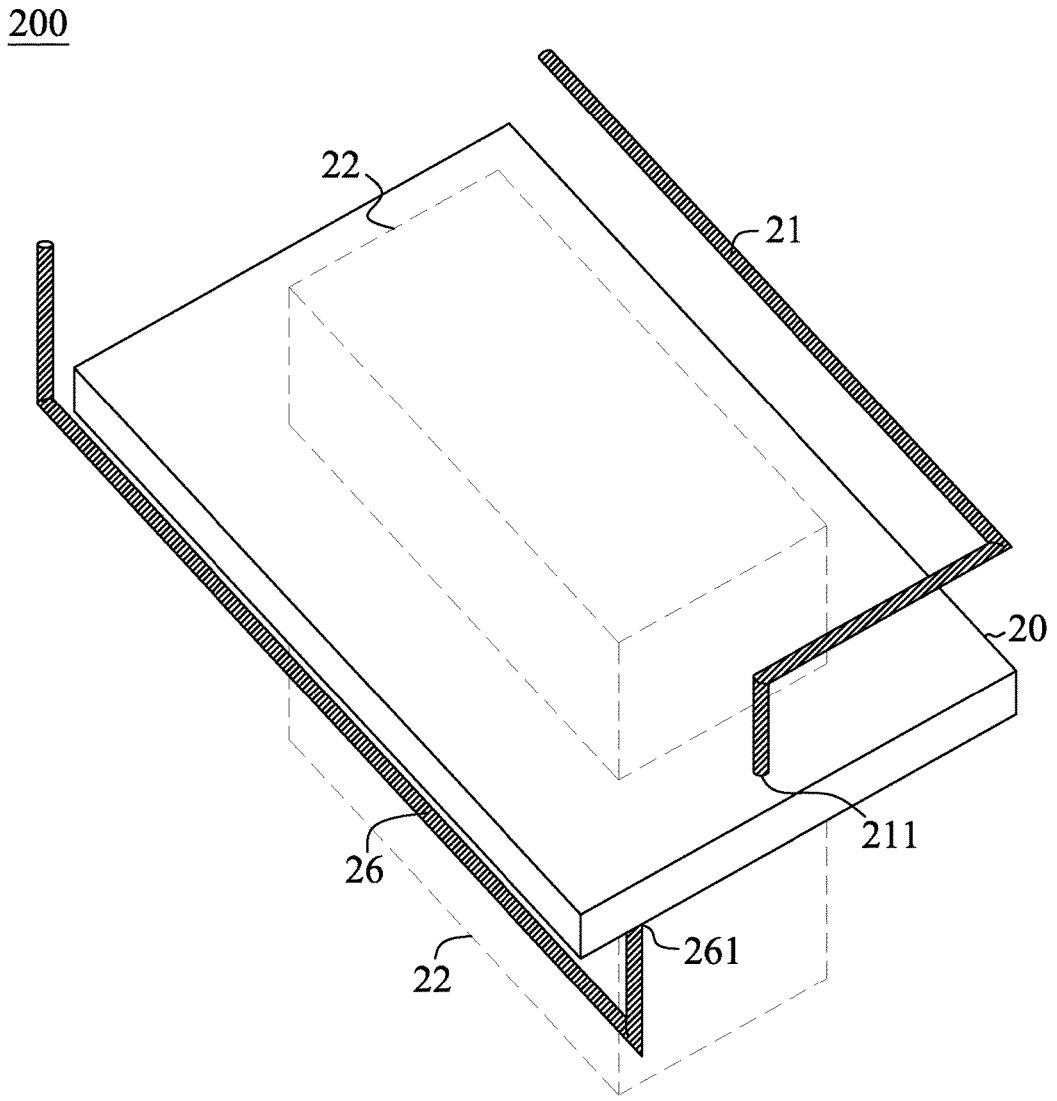
FIG. 2A shows a perspective view of an antenna system with enhanced efficiency according to a first embodiment of the present invention.
Figure 2B:
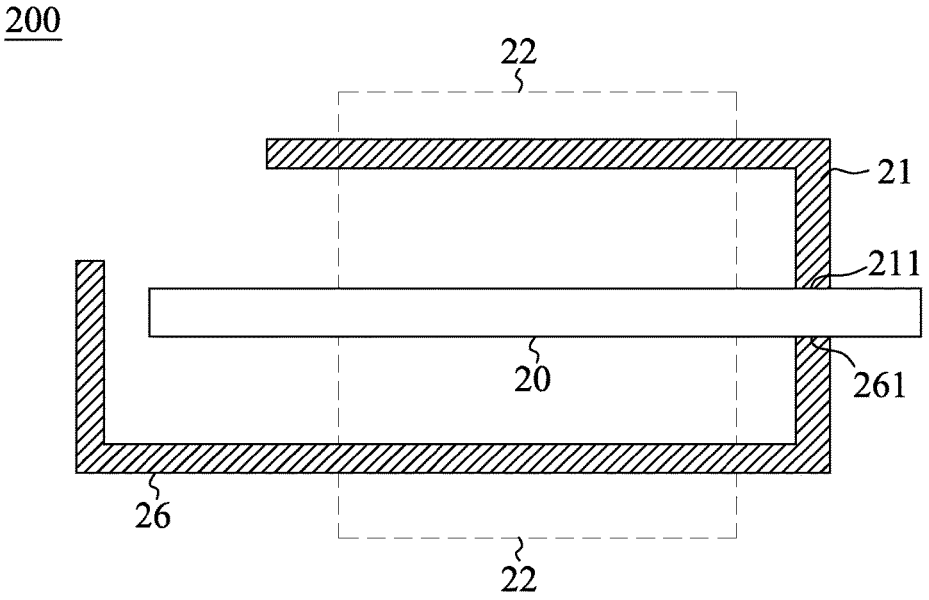
FIG. 2B shows a left-hand view of the antenna system of FIG. 2A.
Figure 3:
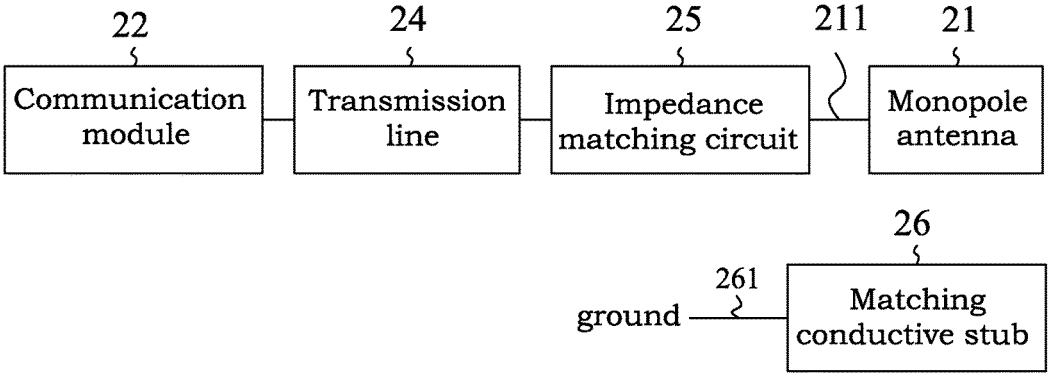
FIG. 3 shows a block diagram illustrated of a communication device.

FIG. 2A shows a perspective view of an antenna system 200 with enhanced efficiency according to a first embodiment of the present invention, and FIG. 2B shows a left-hand view of the antenna system 200 of FIG. 2A. The antenna system 200 of the embodiment may be adapted to communication devices, particularly compact communication devices with small ground plane (e.g., less than ¼ of a wavelength). For example, ¼ of a wavelength at 908 MHz is about 8 centimeters. The compact communication devices may be, but not limited to, sensor devices (e.g., Z-wave devices) of wireless sensor network. The length, width and height of a compact communication device may, for example, be less than 10 centimeters. FIG. 3 shows a block diagram illustrated of a communication device including the antenna system 200.

In the embodiment, the antenna system 200 primarily includes a monopole antenna 21 with a first end connected to a feed point 211 on a printed circuit board (PCB) 20, and a second end being electrically floating. The monopole antenna 21 of the embodiment is a quarter-wave monopole antenna with a length approximately equal to ¼ of a wavelength. For example, ¼ of the wavelength at 908 MHz is about 8 centimeters. For the purpose of avoiding contact or interference, the monopole antenna 21 extends outwards (e.g., upwards) from its first end on a surface (e.g., the first surface) of the PCB 20, and subsequently, extends around a communication module 22 disposed on the PCB 20.

Figure 4A:
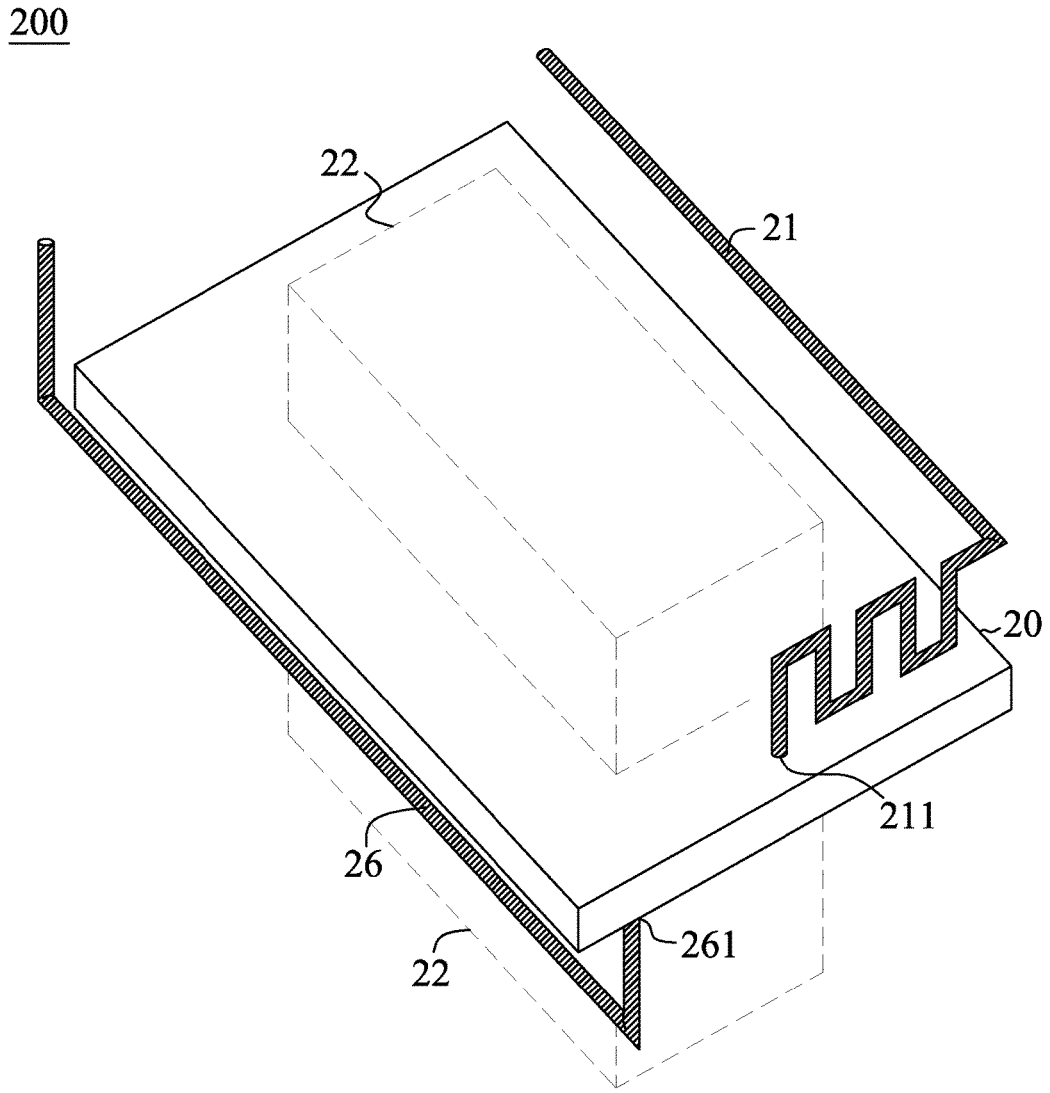
FIG. 4A to FIG. 4C show perspective views of antenna systems with enhanced efficiency according to modified embodiments of the present invention.

Moreover, the monopole antenna 21 may partially curve (for example, in square wave) as exemplified in FIG. 4A. Advantage of a curving monopole antenna 21 is its reduced linear distance, thereby reducing form factor or dimension of the communication devices.

Figure 4B:
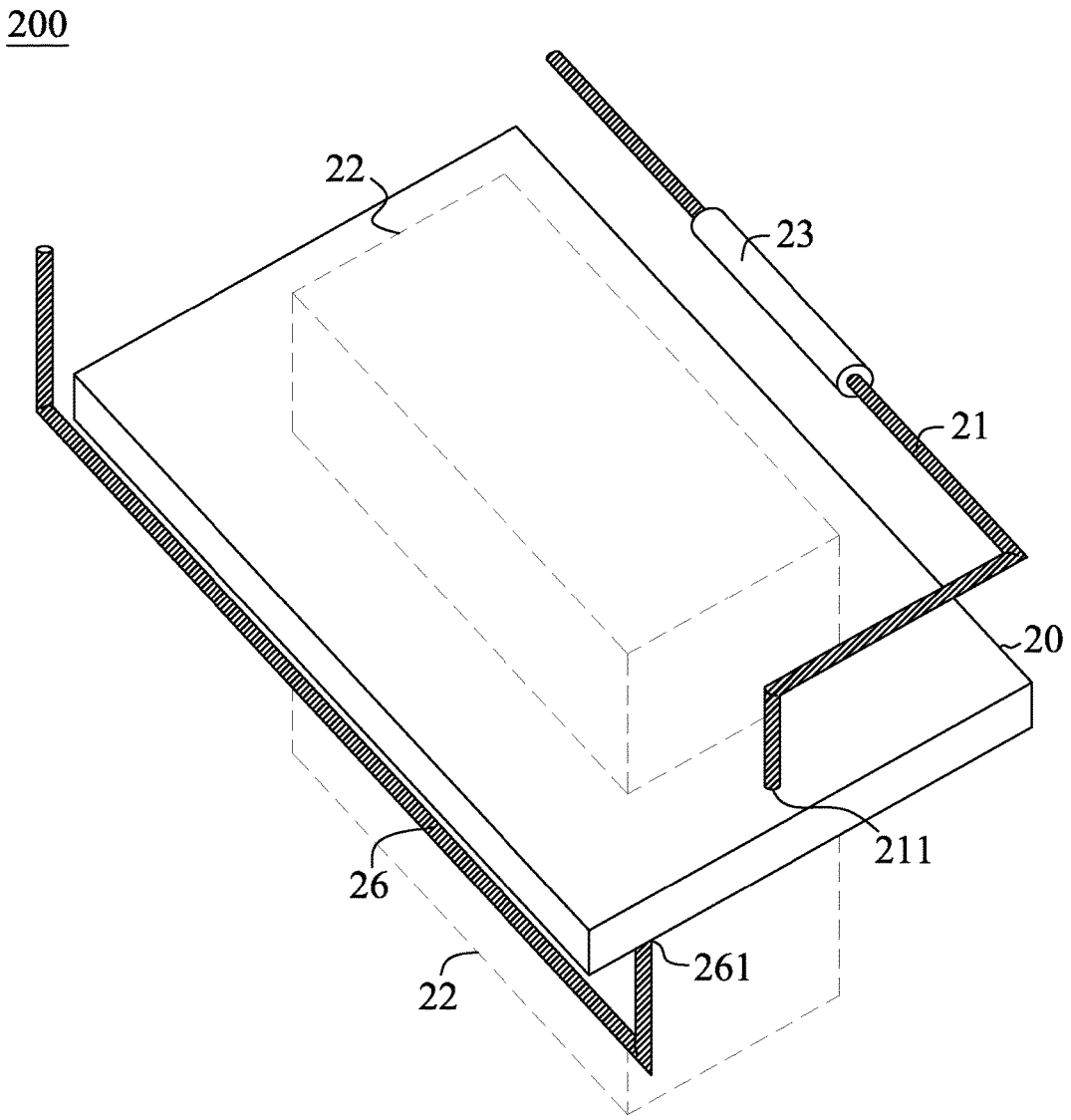

Further, the monopole antenna 21 may partially be coated with a protective sleeve 23 for the purpose of avoiding shorting with an alternating-current (AC) power, as exemplified in FIG. 4B. The monopole antenna 21 of the embodiment may be made of copper, other metals or alloys. The core of the monopole antenna 21 may be replaced with steel, other hard metals or alloys.

A transmission line 24 and an impedance matching circuit 25 may be disposed (e.g., on the surface of the PCB 20) between the communication module 22 and the monopole antenna 21. In the embodiment, the communication module 22 may be, but not limited to, a wireless sensor module. In the specification, the transmission line 24 refers to a cable or other structure designed to carry alternating current of radio frequency. The impedance matching circuit 25 is utilized to match impedance between the transmission line 24 and the monopole antenna 21, and may be implemented by conventional circuit technique.

According to one aspect of the embodiment, the antenna system 200 includes a matching conductive stub 26 with a first end connected to a ground point 261 on the PCB 20, and a second end being electrically floating (or open). The matching conductive stub 26 of the embodiment has a length approximately equal to ¼ of a wavelength. For example, ¼ of the wavelength at 908 MHz is about 8 centimeters. For the purpose of avoiding contact or interference, the matching conductive stub 26 extends outwards (e.g., downwards) from its first end on a surface (e.g., the second surface) of the PCB 20, and subsequently, extends around the communication module 22.

Moreover, the matching conductive stub 26 may partially curve (for example, in square wave). Advantage of a curving matching conductive stub 26 is its reduced linear distance, thereby reducing form factor or dimension of the communication devices.

Figure 4C:
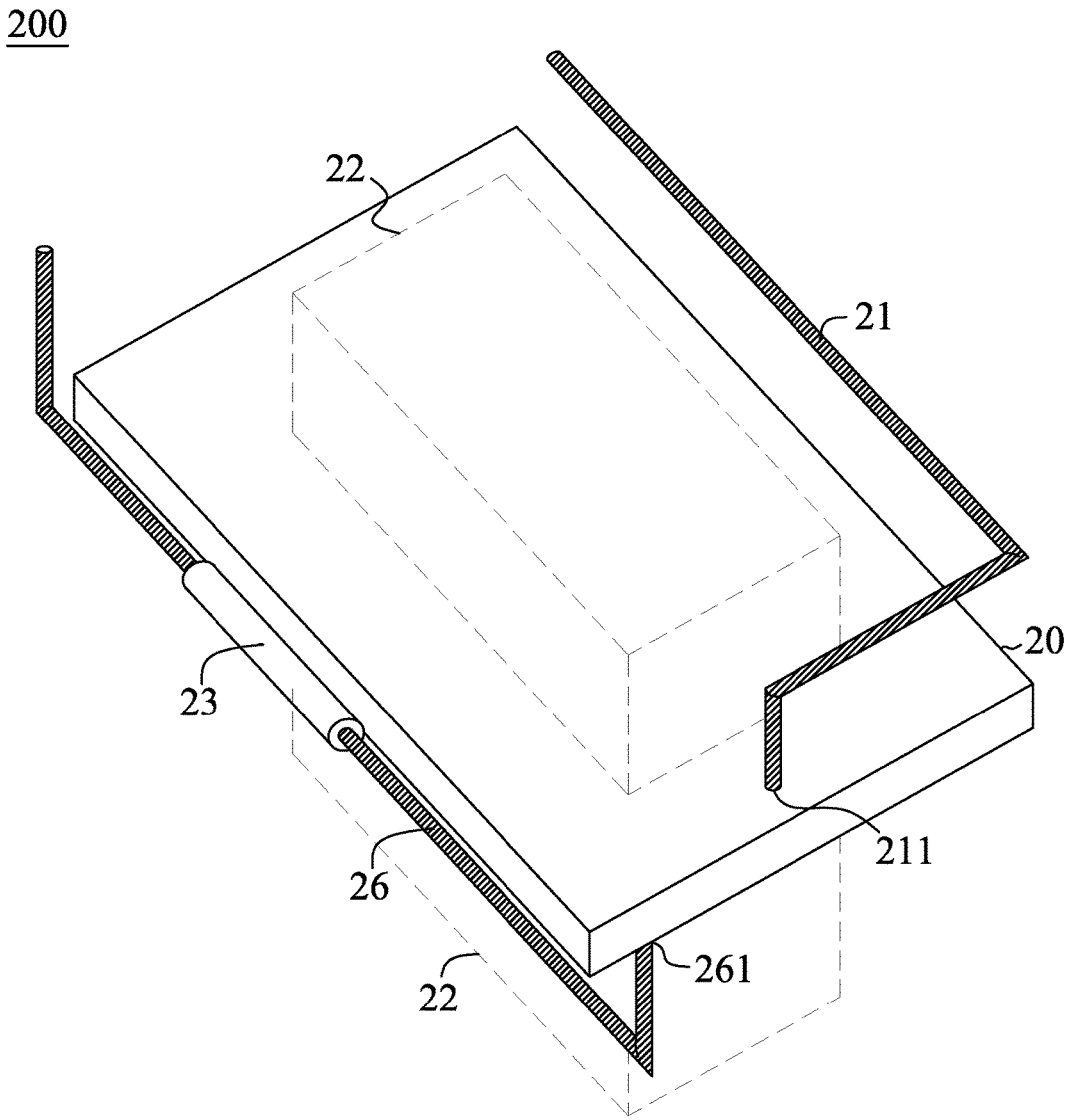

Further, the matching conductive stub 26 may partially be coated with a protective sleeve 23, as exemplified in FIG. 4C. The matching conductive stub 26 of the embodiment may be made of copper, other metals or alloys. The core of the monopole antenna 21 may be replaced with steel, other hard metals or alloys.

According to the embodiment described above, the matching conductive stub 26 can effectively match impedance and raise radiation impedance, thereby substantially enhancing antenna efficiency and compensating for small ground plane of compact communication devices. It is noted that the matching conductive stub 26 should be disposed as near the transmission line 24 as possible to obtain better impedance matching effect.

According to another aspect of the embodiment, the monopole antenna 21 and the matching conductive stub 26 should extend towards opposite directions for the purpose of avoiding or reducing coupling therebetween. Moreover, the feed point 211 of the monopole antenna 21 and the ground point 261 of the matching conductive stub 26 should distance from each other with a predetermined distance.

As exemplified in FIG. 2A, the monopole antenna 21 extends towards right-hand side of the PCB 20, while the matching conductive stub 26 extends towards left-hand side of the PCB 20. In a preferred embodiment, the monopole antenna 21 extends from a top surface of the PCB 20 towards right-hand side above the PCB 20, while the matching conductive stub 26 extends from a bottom surface of the PCB 20 towards left-hand side below the PCB 20. In the embodiment, direct-current (DC) circuits are disposed on the top surface of the PCB 20, and alternating-current (AC) circuits are disposed on the bottom surface of the PCB 20.

Figure 5A:
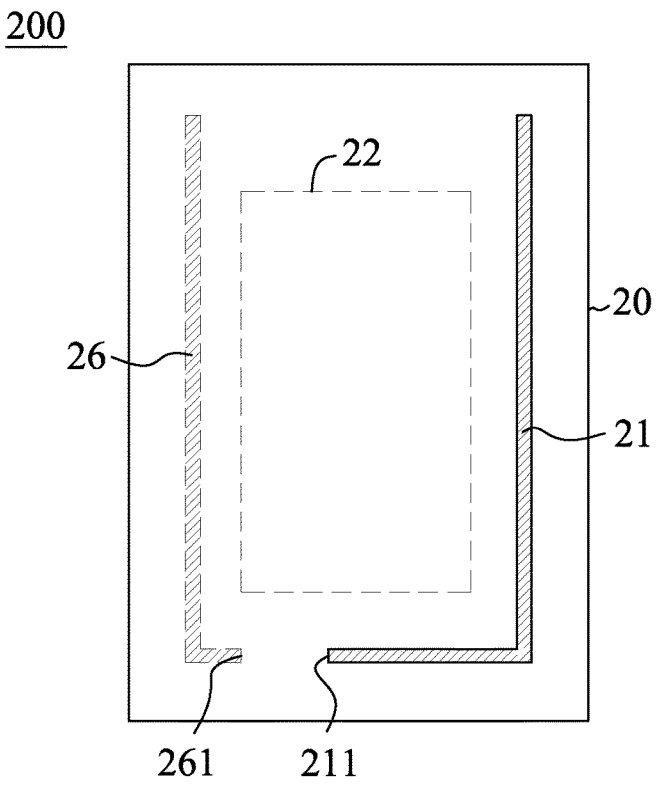
FIG. 5A shows a perspective view of an antenna system with enhanced efficiency according to a second embodiment of the present invention.
Figure 5B:
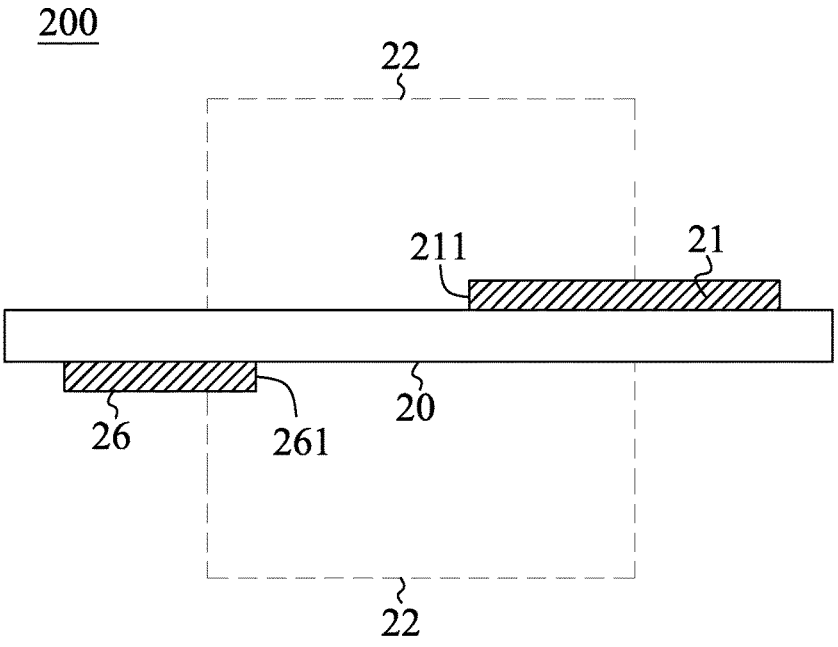
FIG. 5B shows a front view of the antenna system of FIG. 5A.
Figure 5C:
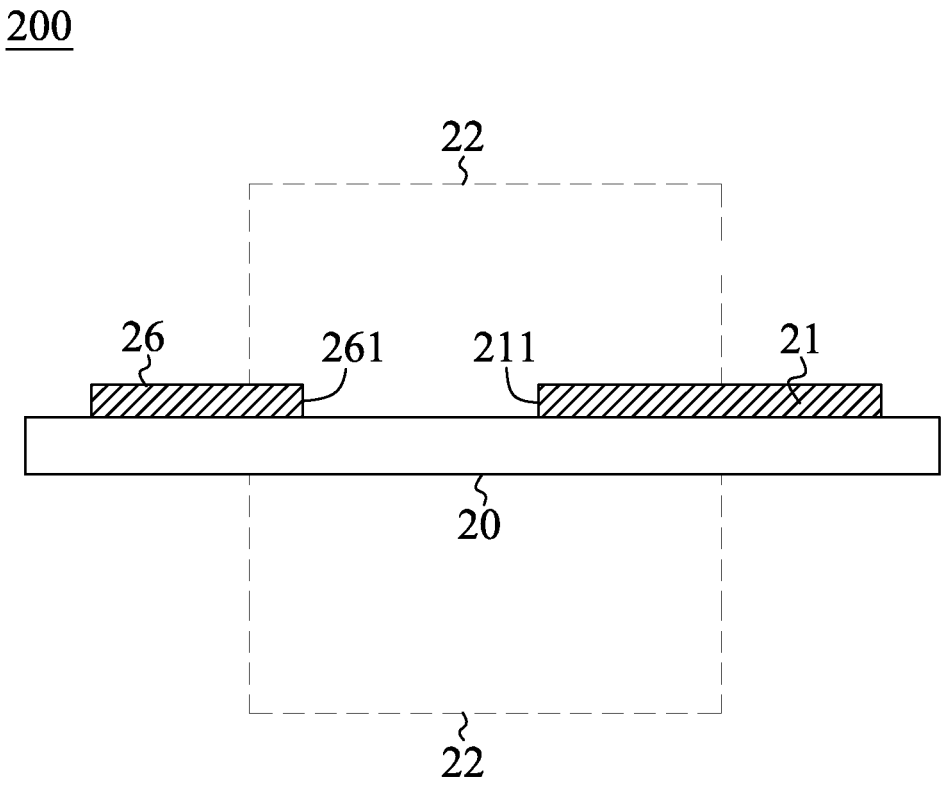
FIG. 5C shows a front view of an antenna system with enhanced efficiency according to a modified embodiment of the present invention.

FIG. 5A shows a perspective view of an antenna system 200 with enhanced efficiency according to a second embodiment of the present invention, and FIG. 5B shows a front view of the antenna system 200 of FIG. 5A. The second embodiment is similar to the first embodiment with the exception that the monopole antenna 21 and the matching conductive stub 26 are formed on a surface of the PCB 20 using printed circuit technique. For example, the monopole antenna 21 is formed on a first surface (e.g., top surface) of the PCB 20, and the matching conductive stub 26 is formed on a second surface (e.g., bottom surface) of the PCB 20. In an alternative embodiment, however, the monopole antenna 21 and the matching conductive stub 26 are formed on the same surface as exemplified in FIG. 5C.

Although both the monopole antenna 21 and the matching conductive stub 26 are formed on the surface(s) of the PCB 20 in the second embodiment, nevertheless, in an alternative embodiment, one of them is formed on the surface of the PCB 20 as in the second embodiment, while the other of them is disposed above the PCB 20 as in the first embodiment.

The monopole antenna 21 and/or the matching conductive stub 26 may partially curve (for example, in square wave) for the purpose of being adapted to compact communication devices. Linear distance of a curving monopole antenna 21 and/or matching conductive stub 26 may thus be reduced, thereby reducing form factor or dimension of the communication devices.

Although specific embodiments have been illustrated and described, it will be appreciated by those skilled in the art that various modifications may be made without departing from the scope of the present invention, which is intended to be limited solely by the appended claims.

What is claimed is:

1. An antenna system comprising:

a monopole antenna with a first end connected to a feed point on a printed circuit board (PCB) and a second end being electrically floating; and a matching conductive stub with a first end connected to a ground point on the PCB and a second end being electrically floating;

wherein the monopole antenna extends outwardly from the first end thereof on the PCB, and subsequently extends around a communication module disposed on the PCB.

2. The system of claim 1, wherein the monopole antenna and the matching conductive stub extend towards opposite directions.

3. The system of claim 1, wherein the matching conductive stub extends outwards from the first end thereof on the PCB, and subsequently extends around the communication module disposed on the PCB.

4. The system of claim 3, wherein the monopole antenna is disposed above a first surface of the PCB, and the matching conductive stub is disposed below a second surface of the PCB, the second surface being opposite the first surface.

5. The system of claim 1, wherein a length of the matching conductive stub is approximately equal to ¼ of a wavelength.

6. The system of claim 1, wherein the matching conductive stub partially curves.

7. The system of claim 1, wherein the matching conductive stub comprises copper.

8. The system of claim 3, wherein the matching conductive stub is partially coated with a protective sleeve.

9. The system of claim 3, wherein a core of the matching conductive stub comprises steel.

10. An antenna system comprising:

a monopole antenna with a first end connected to a feed point on a printed circuit board (PCB) and a second end being electrically floating; and a matching conductive stub with a first end connected to a ground point on the PCB and a second end being electrically floating;

wherein the monopole antenna is formed on the PCB, the monopole antenna extending from the first end thereof on the PCB and subsequently extending around a communication module disposed on the PCB.

11. The system of claim 10, wherein the matching conductive stub is formed on the PCB, the matching conductive stub extending from the first end thereof on the PCB and subsequently extending around the communication module disposed on the PCB.

12. The system of claim 11, wherein the monopole antenna is formed on a first surface of the PCB, and the matching conductive stub is formed on a second surface of the PCB, the second surface being opposite the first surface.

13. A communication device comprising:

a printed circuit board (PCB);

at least one communication module disposed on the PCB;

a monopole antenna with a first end connected to a feed point on the PCB and a second end being electrically floating; and a matching conductive stub with a first end connected to a ground point on the PCB and a second end being electrically floating;

wherein the matching conductive stub extends outwardly from the first end thereof on the PCB, and subsequently extends around a communication module disposed on the PCB.

14. The device of claim 13, wherein the monopole antenna and the matching conductive stub extend towards opposite directions.

15. The device of claim 13, wherein the matching conductive stub extends outwards from the first end thereof on the PCB, and subsequently extends around the communication module disposed on the PCB.

16. The device of claim 13, wherein the monopole antenna is disposed above a first surface of the PCB, and the matching conductive stub is disposed below a second surface of the PCB, the second surface being opposite the first surface.

17. A communication device comprising:

a printed circuit board (PCB);

at least one communication module disposed on the PCB;

a monopole antenna with a first end connected to a feed point on the PCB and a second end being electrically floating; and a matching conductive stub with a first end connected to a ground point on the PCB and a second end being electrically floating;

wherein the monopole antenna is formed on the PCB, the monopole antenna extending from the first end thereof on the PCB and subsequently extending around a communication module disposed on the PCB.

18. The device of claim 17, wherein the matching conductive stub is formed on the PCB, the matching conductive stub extending from the first end thereof on the PCB and subsequently extending around the communication module disposed on the PCB.

19. The device of claim 18, wherein the monopole antenna is formed on a first surface of the PCB, and the matching conductive stub is formed on a second surface of the PCB, the second surface being opposite the first surface.

20. The device of claim 13, wherein a length of the matching conductive stub is approximately equal to ¼ of a wavelength.

21. The device of claim 13, wherein the matching conductive stub partially curves.

22. The device of claim 13, wherein the matching conductive stub comprises copper.

23. The device of claim 15, wherein the matching conductive stub is partially coated with a protective sleeve.

24. The device of claim 15, wherein a core of the matching conductive stub comprises steel.

* * * * *